US005597992A

United States Patent [19]

Walker

[11] Patent Number: 5,597,992

[45] Date of Patent: Jan. 28, 1997

[54] CURRENT INTERCHANGE FOR VACUUM CAPACITOR SWITCH

[75] Inventor: Jan J. Walker, Franklin, Wis.

[73] Assignee: Cooper Industries, Inc., Houston, Tex.

[21] Appl. No.: 604,349

[22] Filed: Feb. 16, 1996

Related U.S. Application Data

[63] Continuation of Ser. No. 352,652, Dec. 9, 1994, abandoned.

[51] Int. Cl.[6] ..... H01H 33/02; H01H 33/66

[52] U.S. Cl. ..... 218/121; 218/124; 218/135; 218/138

[58] Field of Search ..... 218/10, 42, 118–143

[56] References Cited

U.S. PATENT DOCUMENTS

| | | | |
|---|---|---|---|
| 2,981,813 | 4/1961 | Jennings | 218/124 |
| 3,025,375 | 3/1962 | Frank | 218/71 |
| 3,048,682 | 8/1962 | Veras | 218/137 |
| 3,225,167 | 12/1965 | Greenwood | 218/123 |
| 3,234,351 | 2/1966 | Hebb | 218/130 |
| 3,244,843 | 4/1966 | Ross | 218/126 |
| 3,246,979 | 4/1966 | Lafferty et al. | 420/491 |
| 3,283,100 | 11/1966 | Frink | 218/136 X |
| 3,302,990 | 2/1967 | Kurtz et al. | 445/53 |
| 3,321,598 | 5/1967 | Streater | 218/127 X |
| 3,348,012 | 10/1967 | Knapton et al. | 200/267 |
| 3,366,762 | 1/1968 | Smith, Jr. | 218/123 |
| 3,372,258 | 3/1968 | Porter | 218/126 |
| 3,417,216 | 12/1968 | Smith, Jr. | 218/127 |
| 3,440,377 | 4/1969 | Wesoloski | 218/135 |
| 3,450,928 | 6/1969 | Cobine | 313/311 |
| 3,471,669 | 10/1969 | Curtis | 218/140 X |
| 3,586,801 | 6/1971 | Saito et al. | 218/137 |
| 3,590,185 | 6/1971 | Pflanz | 218/134 |
| 3,610,859 | 10/1971 | Schreiner | 200/264 |
| 3,702,911 | 11/1972 | Schonhuber | 218/123 |
| 3,727,018 | 4/1973 | Wesoloski et al. | 218/134 |
| 3,740,507 | 6/1973 | Kuhl et al. | 218/129 |
| 3,773,993 | 11/1973 | Amsler | 218/123 |
| 3,777,089 | 12/1973 | Nitz | 218/136 |
| 3,783,212 | 1/1974 | Bates | 218/130 |
| 3,953,693 | 4/1976 | Pflanz | 218/118 |
| 4,124,790 | 11/1978 | Kumbera et al. | 218/138 |
| 4,150,270 | 4/1979 | Zunick | 218/138 |
| 4,158,911 | 6/1979 | Polinko, Jr. et al. | 29/622 |
| 4,267,415 | 5/1981 | Holmes et al. | 218/139 |
| 4,293,834 | 10/1981 | Date et al. | 335/76 |
| 4,343,030 | 8/1982 | Date et al. | 335/76 X |
| 4,478,347 | 10/1984 | Cherry et al. | 218/136 |
| 4,568,804 | 2/1986 | Luehring | 218/138 |
| 4,713,505 | 12/1987 | Date et al. | 335/76 X |
| 4,780,581 | 10/1988 | Holmgren et al. | 218/59 |
| 4,871,888 | 10/1989 | Bestel | 218/127 |
| 4,879,441 | 11/1989 | Hamm | 218/119 |

OTHER PUBLICATIONS

B. T. Steinbrecher, *Vacuum Capacitor Switch: Introducing a New Product and a Revolutionary Technology*, Cooper Power Systems Division of Cooper Industries, Inc., Oct. 15, 1993 (2 pg.).

McGraw–Edison Power Systems; *Protect Network Transformers with McGarw–Edison Fault Interrupters*; Mar. 1988; (8 pp.).

McGraw–Edison Power Systems; *A Primary Transformer Protecter Utilizing Encapsulated Vacuum Interrupters*; American Power Conference, Chicago, Ill. Apr. 23–25, 1979; (pp. 1–4).

*Primary Examiner*—J. R. Scott

*Attorney, Agent, or Firm*—Conley, Rose & Tayon, P.C.

[57] ABSTRACT

The current interchange includes a housing disposed on a high voltage circuit interrupter. The movable switch contact extends into the housing with a guide member attached to the end of the movable switch contact. The housing includes a base attached to one of the terminals of the interrupter and includes a pair of guide rods extending into the housing for guiding engagement with the guide member. A pair of electrical cables extend helically around the guide rods and have one end attached to the base and another end attached to the guide member to provide an electrical path between the movable switch contact and the terminal. The electrical cables produce an axial magnetic field which maintains the metallic vapor produced by the interruption of the circuit between the contacts to reduce the transport of ions from the gap and reduce the current chop.

16 Claims, 3 Drawing Sheets

CURRENT INTERCHANGE FOR VACUUM CAPACITOR SWITCH

This application is a continuation of application Ser. No. 08/352, 652 filed on Dec. 9, 1994, now abandoned.

BACKGROUND OF THE ART

The invention relates generally to switches for interrupting the flow of electrical current and, particularly, to a vacuum switch for high-voltage circuits, and, still more particularly, to a new and improved current interchange for providing a current path to the movable contact of a vacuum switch.

Vacuum switches are used in a variety of applications. A vacuum switch may be used for capacitor switching or for sectionalizing a line or system of switches. A vacuum switch may also be molded into a "loadbreak" elbow connector to interrupt currents of medium voltage distribution systems. A vacuum switch may also be molded into a solid insulator or be used in a switch enclosure under oil. Typically, vacuum switches are employed as a high-voltage vacuum circuit interrupter.

Loadbreak switches used in voltage power distribution range circuits are of four general types, namely air brake switches, oil insulated switches, gas insulated switches, and vacuum interrupters. The present invention is particularly applicable to high-voltage vacuum-type circuit interrupters which are well known in the art. As used herein, the term "high-voltage" means a voltage greater than 1,000 volts. In such switches, the contacts are enclosed in an evacuated chamber. The vacuum environment rapidly dissipates the gaseous products of the arc drawn between the contacts of the switch to effect interruption of the current when the switch is open.

Typically, a vacuum circuit interrupter includes a pair of electrodes, one being stationary and the other movable between an open and closed position to open and close the circuit. Although vacuum circuit interrupters may be used in either a single-phase or three-phase system, they are commonly used in a three-phase system with multiples of three switches mounted in a common grounded metal enclosure. U.S. Pat. Nos. 3,048,681; 3,048,682; 3,586,801; 3,777,089; and 4,158,911 illustrate vacuum circuit interrupters having opposed electrodes, one being stationary and the other being movable. Such patents also disclose metallic shields to shield portions of the interior of the housing of the interrupter from the metal on the electrodes which is vaporized upon the creation of the resulting arc upon opening a gap between the electrodes to open the interrupter.

U.S. Pat. No. 4,568,804 discloses a high-voltage vacuum type circuit interrupter. The interrupter includes a ceramic insulating housing mounted on a metallic base and a lower housing which includes an actuator. A vacuum module having a housing with an evacuated environment is disposed within the ceramic insulating housing and includes a pair of switch contacts. One switch contact is stationary and is electrically connected to a top or switch electrical terminal. The other contact is movable and is electrically connected to a line terminal and electrical ground. A dielectric operating rod is connected to the movable switch contact and to the actuator. The switch contacts are mounted within a metallic vapor shield. A metallic bellows is used to seal the lower movable contact.

Another form of a vacuum switch is shown in U.S. Pat. No. 2,981,813. Two opposed stationary contact rods extend into a hermetically sealed and vacuumized envelope with a gap between the terminal ends thereof. A contact means in the form of a copper disc is mounted on an actuator shaft. The actuator shaft includes a dielectric post having one end affixed to the contact means and the other end affixed to a metallic rod extending through an expansible metallic bellows and through an aperture in the envelope for connection to an operating means for actuating the contact means. The dielectric post electrically insulates the contact means from the rod and bellows. One end of the bellows is hermetically sealed with the envelope and the other end is connected to the inner end portion of the rod.

As shown in U.S. Pat. No. 4,568,804, the interrupter includes an elongated, dielectric operating rod having a movable switch contact disclosed at its uppermost longitudinal end. The movable switch contact is movable relative to a stationary or fixed switch contact so as to open or close the electrical circuit path between two terminals. The operating rod is actuated by an actuator member such as the solenoid operated toggle mechanism shown in the '804 patent. The '804 patent teaches a conductive contact stem mounted on the end of the operating rod. A direct electrical connection is maintained between the contact stem of the movable switch contact and one of the side terminals. The '804 patent teaches a contact block which maintains electrical engagement with the movable contact stem and the side terminal. A metallic bellows has one movable end fixed to the contact stem and another stationary end fixed to the housing to preserve the vacuum during the movement of the movable switch contact.

U.S. Pat. No. 4,124,790 teaches a current transfer assembly for the movable contact. Other patents, such as U.S. Pat. Nos. 3,025,375 and 3,471,669, teach shunts or connecting leads extending between the movable contact and terminal.

Various other methods of forming the electrical current path between the moving rod and terminal include straight wire cords, interleaved copper foil, garter spring sliding contacts, a mercury well, and a moving link. However, such prior art devices have not been compact and require substantial inertia and force to reciprocate the moving rod between the open and closed positions. Because of the length requirements of the vacuum switch, the straight wire cords tend to apply a resistive force to the contact stem at either end of the stroke. The interleaved copper foil includes approximately 100 layers of one-thousandths inch thick copper foil approximately an inch wide. This copper foil has the same deficiency as that of the straight wire cords.

The present invention is compact both in the axial and radial directions and is shorter both in length and radial dimension as compared to the prior art. The present invention includes a low inertia and low force interrupter that provides an electrical current path between the moving contact stem and a terminal of the vacuum switch. Further, the present invention provides a means of sealing the encapsulation die during production. The present invention overcomes the deficiencies of the prior art.

SUMMARY OF THE INVENTION

The current interchange of the present invention is used with a high voltage circuit interrupter. The high voltage circuit interrupter includes an insulated housing with a dielectric cylindrical inner casing with a first electrical terminal mounted on one end and connected to a high voltage power lead and a second terminal mounted on the housing and connected to a second high voltage power lead.

A current interrupting vacuum switch is disposed within the casing for selectively opening and closing an electrical path between the two terminals. The switch includes a stationary switch contact in electrical engagement with the first terminal and a movable switch contact which is connected by the current interchange to the second terminal. The movable switch contact is moved by an actuator into and out of contact with the stationary switch contact.

The current interchange includes an enclosure disposed on the casing with one end of the movable switch contact projecting into the enclosure. An expandable seal is disposed around the end of the movable switch contact for maintaining the vacuum seal. Guide rods project into the enclosure for engagement with a guide member affixed to the end of the movable switch contact. Electrical cables extend helically around the guide rods with one end of the cables being attached to a stationary cable end base in electrical engagement with the second terminal and the other end of the electrical cables affixed to the movable guide member in electrical engagement with the movable switch contact. The electrical cables have sufficient length to allow for the stroke of the movable switch contact within the enclosure. The electrical cables have a pitch which produces an axial magnetic field to assist in the interruption of the circuit between the stationary and movable switch contacts. The axial magnetic field also maintains and controls the metallic particles produced in the opening of the switch.

Other objects and advantages of the present invention will appear from the following description.

BRIEF DESCRIPTION OF THE DRAWINGS

For a derailed description of a preferred embodiment of the invention, reference will now be made to the accompanying drawings wherein.

DETAILED DESCRIPTION OF A PREFERRED EMBODIMENT

Figure 1:
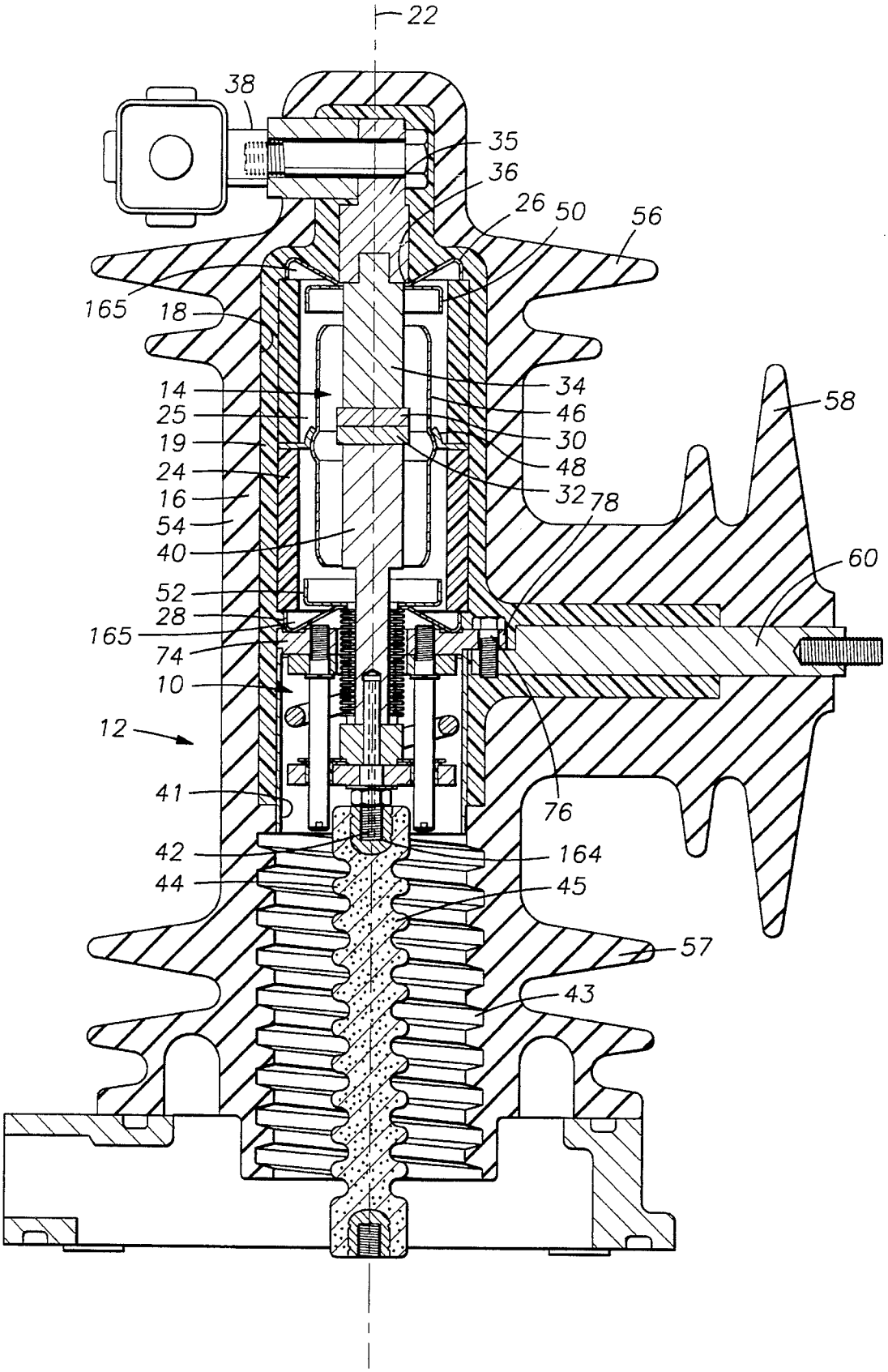
FIG. 1 is a cross-sectional side elevational view of a vacuum switch with the vacuum switch interrupter of the present invention.

Referring initially to FIG. 1, the current interchange 10 of the present invention is disposed in a capacitor switch 12 having a vacuum interrupter 14 shown as the preferred embodiment for use with the present invention. Vacuum capacitor switch 12 of the preferred embodiment is a high-voltage vacuum-type circuit interrupter. The vacuum capacitor switch 12 includes an enclosure 16 having a generally cylindrical shape. The term "generally cylindrical" is used to mean that the housing is substantially cylindrical but not necessarily a circular cross-section. Other less preferred cross-sections may be employed, if desired. The cylindrical enclosure 16 includes a cylindrical bore 18 having a vertical axis 22. Enclosure 16 is molded in an insulating material such as a cycloaliphatic epoxy 54.

A tubular casing 24 of insulating material, such as ceramic or a suitable glass, and a pair of metallic end caps 26, 28 closing the ends of casing 24 are disposed within cylindrical bore 18 of housing 16. Polyurethane 19 is disposed around casing 24 in bore 18. Casing 24 is cylindrical forming a chamber 25. End caps 26, 28 are sealed to the casing 24 to render chamber 25 vacuum-tight.

End caps 26, 28 are preferably stainless steel and are affixed to cylindrical casing 24 such as by brazing. The metal end caps are brazed to the metallized ceramic casing 24 with a high temperature alloy. Any high temperature alloy may be used as a suitable brazing alloy. The alloy is melted at the interface of the parts, like a solder, to form a vacuum, hermetic seal. A pair of switch contacts 30, 32 are disposed within the envelope or chamber 25 of casing 24. Contacts 30, 32 are shown in FIG. 1 in the closed-circuit position. Contacts 30, 32 may have contact points formed from cooper-impregnated tungsten.

Contact 30 is disposed on the terminal end of a conductor 34. Conductor 34 passes through an aperture in the end of cap 26 and is brazed thereto at 36. The other terminal end of conductor 34 is affixed to an upper extension conductor 35 which is in electrical engagement with a terminal 38. Thus, contact 30 is affixed to conductor 34 and therefore is the stationary contact.

Contact 32 is the movable contact and is mounted on one terminal end of conductor 40. Conductor 40 is a movable contact stem or rod extending into current interchange 10. The other terminal end of contact rod 40 is attached by a threaded stud 42 to an actuator rod 44 mounted to an actuator means (not shown). Rod 44 is threaded onto the threaded end 164 of stud 42. Actuator rod 44 is made of an insulating or dielectric material, such as a skirted plastic glass-filled epoxy that will not conduct the electricity passing through conductor rod 40 to the actuator means (not shown). Actuator rod 44 includes a plurality of annular ring-like projections 45 along the longitudinal length of rod 44 to extend the longitudinal surface length of rod 44 along axis 22. This extended surface length inhibits the voltage from jumping to short out the switch.

The actuator means is a quick-close/quick-open, motor-driven, over-toggle spring type device. This type of mechanism provides the necessary speeds and forces to adequately interrupt the capacitive current and also provides close and latch capability. Appropriate linkage is included to accommodate an external manual operating handle for both manual opening and closing, and positive contact position indication. The components of the mechanism are chosen for their ability to work without lubricants. For corrosion resistance and long-maintenance-free life, many components are stainless steel or E-coated mild steel. The whole mechanism is then sealed in a housing.

The actuator means reciprocates rods 44, 40 and thus movable contact 32 away from stationary contact 30 thereby creating a circuit-interrupting or arcing gap between contacts 30, 32. The resulting are, although quickly extinguished, vaporizes some of the metal on the contacts 30, 32. In order to prevent this metallic vapor from condensing on the internal insulating surfaces within chamber 25, a generally cylindrical, central metallic shield 46 is mounted within chamber 25 by supports 48. Metallic shield 46 extends along the interior axial length of tubular casing 24 for substantial distances on both sides of the point of electrical engagement of contacts 30, 32. Shield 46 is mounted adjacent the central region of casing 24 and is spaced radially outward of conductors 34, 40. Shield 46 is electrically isolated from both of the conductors 34, 40 and, preferably, is also isolated from ground, or in other words, is at a floating potential relative to the two electrodes or conductors 34, 40.

Further, upper and lower internal end shields 50, 52 are disposed adjacent end caps 26, 28, respectively, to shield the ionized emission from the electrical triple point 165 located at each end of casing 24 at the junction of ceramic casing 24, end caps 26, 28 and the internal vacuum space in chamber 25. Since each end shield is of common construction, a description of end shield 50 will also be descriptive of end shield 52. End shield 50 includes a cylindrical body with a flaring annular cylindrical terminal end. The outside diameter of shields 50, 52 are sized to be received within chamber 25 with only a small clearance with casing 24.

Essentially all straight line paths extending from the central region of the arcing gap between contacts 30, 32 and the insulated casing 24 are intercepted by floating central shield 46 and upper and lower end shields 50, 52. As a result, substantially all metallic particles that are liberated from the contacts 30, 32 on electrodes 34, 40 by arcing are intercepted and captured either by central shield 46 or upper and lower end shields 50, 52 before they can reach the internal surfaces of casing 24.

The current interchange 10 includes a stainless steel housing 70 having its upper end disposed in a counterbore 72 of a stationary current interchange base 74. Interchange base 74 is made of copper and is electrically connected to side terminal 60 at 76. Current interchange base 74 includes a projecting extension 78 for attachment to terminal 60 as best shown in FIG. 1. Air insulators 56, 58 are disposed around terminals 38, 60, respectively.

Insulated housing 16 further includes a reduced diameter cylindrical bore 41 which slidingly receives the lower end of stainless steel housing 70 of current interchange 10. This sliding contact supports the lower end of current interchange 10 as well as electrodes 34, 40 with contacts 30, 32. The upper extension conductor 35 of conductor 34 supports the upper end of the assembly by being affixed to terminal 38. A plurality of weather sheds or air insulators 57 are also disposed around the lower end of housing 16. As best shown in FIG. 1, the reduced diameter bore 41 of housing 16 includes buttress type threads 43. These threads 43 extend around actuator rod 44 to extend the longitudinal surface length of bore 41 along axis 22. Similarly, as with respect to the ring-like projections 45 on rod 44, the threads 43 along bore 41 extend the surface length of housing 16 to inhibit the voltage from jumping to short out the switch.

Figure 2:
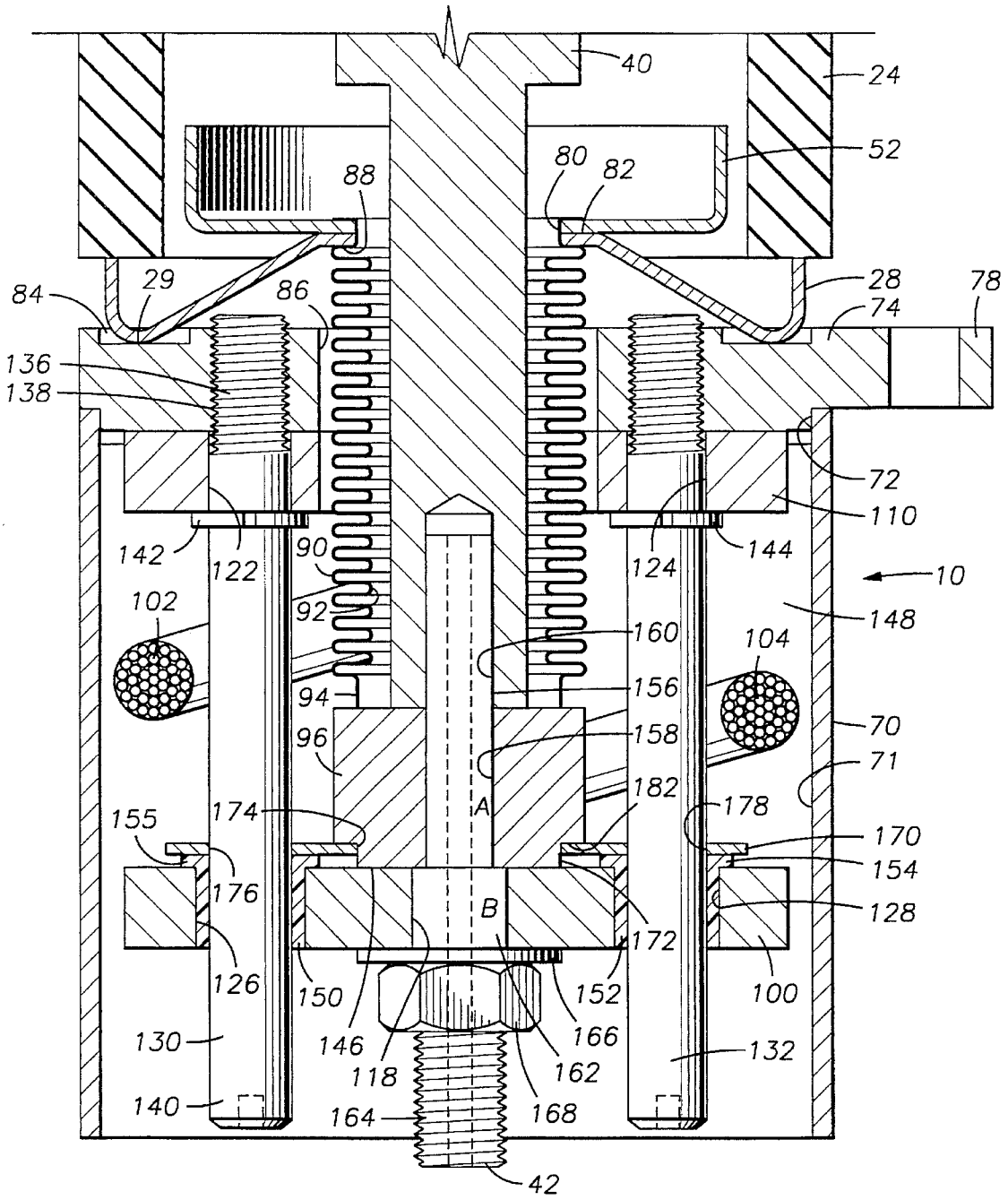
FIG. 2 is an enlarged cross-sectional elevational view of the vacuum switch interrupter in FIG. 1.

Referring now to FIG. 2, end cap 28 includes an outer peripheral cylindrical portion which curves inwardly to form an inner conical portion terminating at a central aperture 80. Lower end shield 52 is brazed to and supported by end cap 28 at 82 around aperture 80. The inner conical portions of end caps 26, 28 reduce the length of housing 16 to avoid physical constraints in the installation of the current interchange 10.

Current interchange base 74 includes an annular groove 84 in one face for receiving the annular curved portion 29 of end cap 28. End cap 28 is affixed to current interchange base 74 at the bottom of groove 84 by means such as brazing. Current interchange 74 further includes a central aperture 86 through which extends a bellows seal 90 for sealing the free end of movable contact rod 40 during reciprocation. One terminal end 88 of bellows seal 90 is brazed at aperture 80 to end cap 28 whereby end cap 28 supports one end of bellows seal 90. As shown, the movable contact rod 40 extends through the bore 92 of bellows 90. The other end 94 of bellows 90 is affixed by brazing to a spacer 96. Bellows seal 90 maintains the vacuum, hermetically sealed chamber 25 by establishing a seal between the casing 24 and conductor rod 40 during the mechanical motion of rod 40. With the inner end of the interior conical portion of end cap 28 projecting into chamber 25 of casing 24, and by having end cap 28 support bellows seal 90, one end of bellows seal 90 is disposed within chamber 25 so as to allow adequate stroke of the bellows during the reciprocation of conductor rod 40. Further, by having bellows seal 90 extend into chamber 25, the axial length of current interrupter 10 is shortened.

Figure 3:
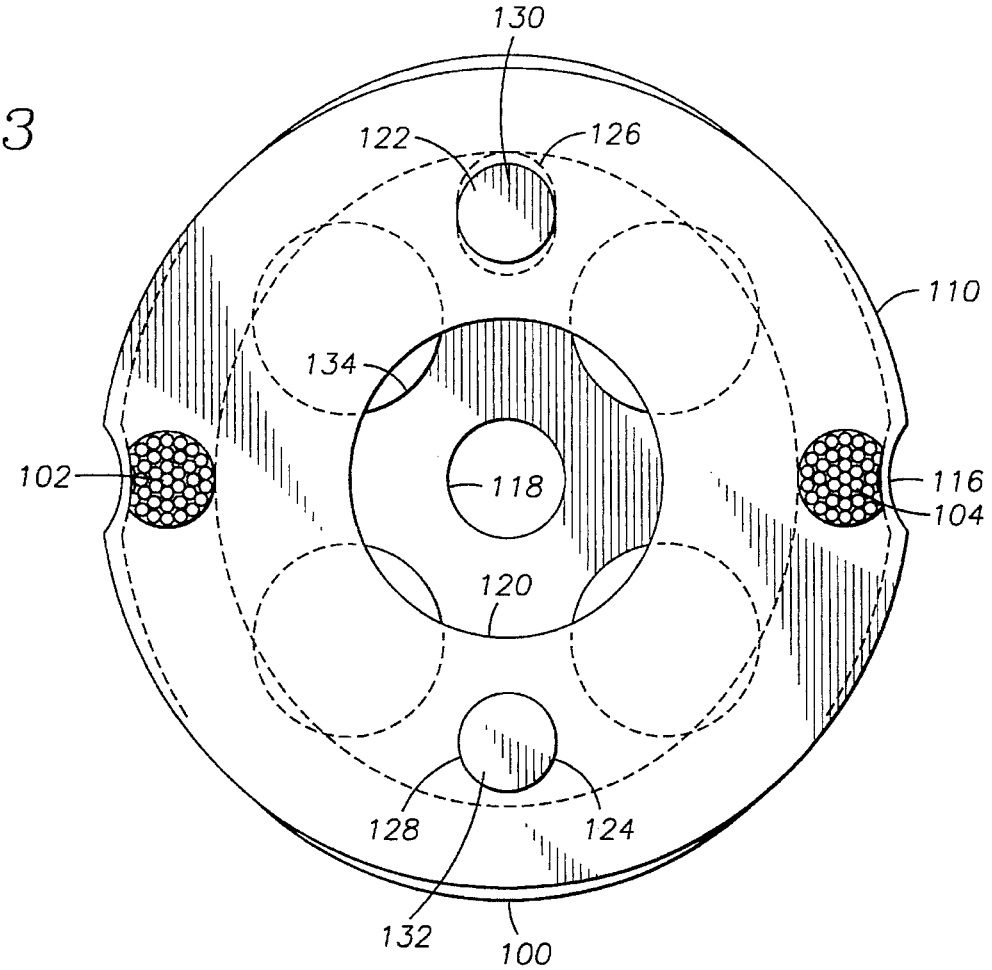
FIG. 3 is an end view of the cable assembly shown in FIG. 2.
Figure 4:
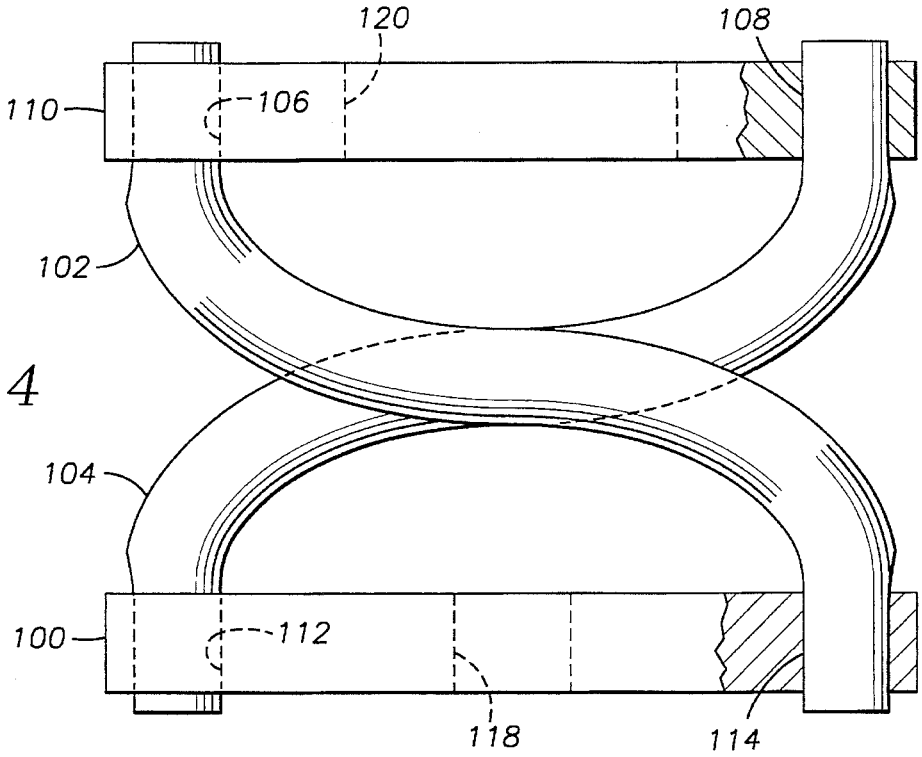
FIG. 4 is a side elevational view of the cable assembly of FIG. 3.

Referring now to FIGS. 2, 3, and 4, there is shown the current interrupter 10 with a cable assembly for providing a conductive path between current interchange base 74 and movable conductor rod 40. The cable assembly includes a movable cable end 100 and a stationary cable end 110 in the form of disks made of copper and having a pair of flexible copper cables 102, 104 extending therebetween in a helical manner. One of the ends of cables 102, 104 are received by a pair of apertures 106, 108 in stationary cable end 110 and the other ends of cables 102, 104 are received within apertures 112, 114 in movable cable end 100. The ends of cables 102, 104 are affixed within apertures 106, 108 and 112, 114 such as by crimping as at 116.

Movable and stationary cable ends 100, 110 also include a plurality of co-axial apertures. Aperture 120 in stationary cable end 110 has a diameter common to the diameter of bore 86 in current interchange base 74 for receiving bellows seal 90. Movable cable end 100 includes an aperture 118 for receiving threaded stud 42. Referring particularly to FIG. 3, stationary cable end 110 includes aligned guide apertures 122, 124 which are co-axial with aligned guide apertures 126, 128 in movable cable end 100. Apertures 122, 124 and 128 are circular in cross-section while aperture 126 in movable cable end 100 is elliptical. Apertures 122, 126 and 124, 128 receive guide rods 130, 132, respectively, as hereinafter described in further detail. Movable cable end 100 further includes a plurality of gas apertures 134 for allowing the venting of gases between cable ends 100, 110 upon reciprocation of movable cable end 100 within the cylindrical bore 148 formed by stainless steel housing 70. The failure to have gas apertures 134 would cause a dash pot effect upon the reciprocation of movable cable end 100 which would then act like a piston and cause the movable contact rod 40 and movable cable end 100 to lock up.

Referring again to FIG. 2, guide rods 130, 132 are stainless steel studs and have a threaded end 136 which is threadingly received within tapped bore 138 in the current interchange base 74. The free ends 140 of guide rods 130, 132 project into the bore 148 of stainless steel housing 70. Guide rods 130, 132 are first received within alignment apertures 122, 124 of stationary cable end 110. Stationary cable end 110 is attached to and maintained against interchange base 74 by integral annular shoulders 142, 144 on guide rods 130, 132, respectively. Annular shoulders 142, 144 bear against the face of stationary cable end 110 as threaded end 136 engages tapped bore 138 in current interchange base 74. Alternatively, snap rings housed within snap ring grooves in guide rods 130, 132 may be used in place of integral annular shoulders 142, 144. Current interchange base 74 and stationary cable end 110 are separate parts because cable ends 100, 110 cannot be subjected to a brazing cycle such as upon affixing stainless steel housing 70 to current interchange base 74 and affixing current interchange base 74 to end cap 28 of casing 24. Only current interchange base 74 is brazed to end cup 28 of current interchange 10.

Sleeve bushings 150, 152 are mounted within apertures 126, 128, respectively, of movable cable end 100 to facilitate movable cable end 100 reciprocating on guide rods 130, 132. Sleeve bushings 150, 152 include annular flanges 154, 155, respectively, which engage the face of movable cable end 100. The free ends 140 of guide rods 130, 132 are received within sleeve bushings 150, 152, respectively, with self-alignment aperture 126 and movable cable end 100 allowing for the self-alignment of movable cable end 100 on guide rods 130, 132.

As best shown in FIG. 2, the guide rods 130, 132 are disposed radially inwardly of cables 102, 104. Cables 102, 104 extend helically around guide rods 130, 132 adjacent the inner wall 71 of housing 70 as cables 102, 104 extend between stationary cable end 110 and movable cable end 100.

Spacer 96 includes a reduced diameter portion 172 for receiving a bearing retainer 170 of sheet metal. Bearing retainer 170 includes a central bore 174 which receives reduced diameter end 172 of spacer 96. Bearing retainer 170 also includes apertures 176, 178 for receiving guide rods 130, 132, respectively. Bearing retainer 170 engages the face of flanges 154, 155 on sleeve bushings 150, 152 to maintain sleeve bushings 150, 152 in place within apertures 126, 128. The shoulder 182 formed by reduced diameter portion 172 of spacer 96 forces retainer 170 against the top of flanges 154, 155 to hold sleeve bushings 150, 152 in place. Sleeve bushings 150, 152 are disposed in apertures 126, 128 for receiving guide rods 130, 132, respectively, to facilitate the movable cable end 100 reciprocating on guide rods 130, 132.

Referring particularly to FIG. 2, threaded stud 42 includes a reduced diameter shaft 156 which extends through a bore 158 in spacer 96 and a bore 160 in the lower terminal end of contact rod 40. Stud 42 is brazed to spacer 96 and movable contact rod 40. Stud 42 also includes a smooth shaft portion 162 which projects through aperture 118 of movable cable end 100. The terminal end 164 of stud 42 is threaded to receive a washer 166 and nut 168. The threaded end 164 with washer 166 and nut 168 attaches movable cable end 100 to spacer 96 and thus movable contact rod 40. Stud 42 being brazed to spacer 96 and contact rod 40 and with washer 166 and nut 168 affixing movable cable end 100 to spacer 96 actually makes the electrical connection to the interrupter 10 together with the mating contact between the facing surfaces of spacer 96 and movable cable end 100 at 146. Actuator rod 44 is threaded onto threads 164 of stud 42.

Cables 102, 104 extend helically around guide rods 130, 132 between movable cable end 100 and stationary cable end 110 and generate an axial magnetic field. This axial magnetic field is generated by the spiral current path due to the pitch of the copper cables 102, 104. The axial magnetic field is generated in the axial direction, i.e. along axis 22. The axial magnetic field also controls and contains the metallic arc products and maintains those products in the general area of contacts 30, 32. Upon the separation of contacts 30, 32, the axial magnetic field aids in holding the ions in the gap between contacts 30, 32 as contacts 30, 32 separate until the area goes to zero current thereby preventing the conduction of the ions to other areas within chamber 25. Maintaining the ions in the gap also reduces current chop.

The design of the current interchange 10 of interrupter 14 also facilitates the injection molding process for enclosure 16. Stainless steel tube 70 provides a means to seal the encapsulation die during the injection molding process, well known in the art. The gelation for the injection molding process is placed under high pressure. A member having an exterior O-ring is placed inside the stainless steel housing 70 for sealingly engaging the interior diameter wall of stainless steel housing 70. The current interchange 10 is assembled after the encapsulation die has been used.

In operation, current may flow in either direction through terminals 38, 60, i.e., the terminals can act either as a load or feeder. In the closed position, movable contact 32 is in its innermost position within casing 24 and in electrical engagement with stationary contact 30. Current is conducted through contacts 30, 32 via terminals 38, 60. Upon command, the actuator means (not shown) actuates actuator stem or rod 44 causing movable contact rod 40 and thus movable contact 32 to move away from stationary contact 30. The stroke of rod 40 is in the range of ¼ to 5/16 of an inch. As contact rod 40 moves towards the actuator means, bellows seal 90 expands as movable cable end 100 moves toward the free ends 140 of guide rods 130, 132. Cables 102, 104 have sufficient length in their helical position to allow movable cable end 100 to move away from stationary cable end 110 while maintaining electrical conduction between cable ends 100, 110. The cables 102, 104 allow a low friction mechanical movement of movable cable end 100.

As contacts 30, 32 disengage and interrupt circuit flow, an arc occurs between contacts 30, 32. Although metallic vapor products are formed as a result of the electrical arcing across open switch contacts 30, 32, vapor shields 46, 50 and 52 shield the interior of chamber 25 from the deposition of this metallic vapor. Upon the extinguishment of the arc, there is a standoff of the voltage and the circuit is open.

The switch of the present invention is preferably designed for 200 amps, 15 kV class for a 95 kV BIL device having a closed-end-latch rating of 9,000 amps. The switch is electrically operable in any mounting orientation such a vertical, horizontal, or inverted. It is also suitable for operation through a temperature range of plus 40° C. to –40° C.

The orientation of the switch 12, with respect to the mounting bracket, is infinitely adjustable throughout 270°. A five pin control wiring receptacle is standard. The switch 12 may be used for 30,000 parallel bank switching operations at 200 amps and 15 kV. The switch 12 is lightweight, easy to handle, and easy to install. It has a single bolt mounting bracket, single bolt clamp-type line terminals, and a standard receptacle for control wiring. The external hardware is all stainless steel and the mounting enclosure is a deep drawn steel with a polyester powder paint.

One of the advantages of the cable assembly of the present invention is that it is self-guiding. Also, only a low inertia force is required to reciprocate movable cable end 100 on guide rods 130, 132, thus allowing for a low-force, low-inertia movement. The configuration of the cables 102, 104 provides very little resistance to the motion of the movable cable end 100. This occurs due to the position of the cables 102, 104 extending in a helical manner around guide rods 130, 132 and between cable ends 100, 110. The design of the present invention also allows the interrupter 14 to be compact both in the axial and radial directions.

While a preferred embodiment of the invention has been shown and described, modifications thereof can be made by one skilled in the art without departing from the spirit of the invention.

I claim:

1. A current interrupter for a switch comprising:

a housing forming a chamber;

a switch contact disposed in said chamber and having a conductive member with a movable stroke between a conducting position for conducting electricity and a non-conducting position for not conducting electricity;

a terminal for conducting electricity when said switch contact is in said conducting position;

an expansible seal having a stationary end supported within said chamber and a movable end affixed to said conductive member;

at least one electrical conductor having a first end in electrical engagement with said conductive member and a second end in electrical engagement with said terminal;

said terminal being disposed on said housing at a location between said switch contact and said movable end;

said one electrical conductor having a length which is longer than said stroke of said conductive member between said conducting and non-conducting positions so as to extend around said conductive member from said terminal to said first end.

2. The interrupter of claim 1 further including at least one guide member for guiding said electrical conductor during said stroke.

3. The interrupter of claim 1 further including two electrical conductors extending between said conductive member and said terminal, said electrical conductors curling around said conductive member and having a pitch for producing an axial magnetic field to assist in moving to the non-conducting position and for controlling metallic arc products.

4. The interrupter of claim 1 further including a steel tube for enclosing said electrical conductor.

5. A high voltage circuit interrupter comprising:

a first electrical terminal for connection to a first high voltage power lead;

a second electrical terminal for connection to a second high voltage power lead;

a housing having a first chamber and a second chamber;

a current interrupting switch disposed within said first chamber for selectively opening and, alternatively, closing an electrical path between said first and second terminals;

said switch including a stationary switch contact in electrical engagement with said first terminal and a movable switch contact having an electrode member extending into said second chamber;

a current interchange disposed within said second chamber for electrically connecting said movable switch contact and said second terminal, said movable switch contact being movable alternately into and out of engagement with said stationary switch contact to respectively close and open said electrical path;

an actuator connected to said electrode member for moving said movable switch contact into and out of engagement with said stationary switch contact;

said current interchange receiving one end of said movable switch contact and for electrical engagement with said second terminal;

an expansible seal having a stationary end supported within said first chamber and a movable end affixed to said electrode member, said movable end being disposed within said second chamber; and an electrical conductor having one end electrically connected to said electrode member and another end electrically connected to said second terminal.

6. The interrupter of claim 5 wherein said expansible seal extends into said second chamber and having an interior aperture for receiving said electrode member, one end of said seal being sealed to said housing and the other end of said seal being sealed to said one end of said electrode member.

7. A high voltage circuit interrupter comprising:

a first electrical terminal for connection to a first high voltage power lead;

a second electrical terminal for connection to a second high voltage power lead;

a rigid dielectric housing having a chamber;

a current interrupting vacuum switch disposed within said chamber for selectively opening and, alternatively, closing an electrical path between said first and second terminals;

said switch including a stationary switch contact in electrical engagement with said first terminal and a movable switch contact;

a current interchange electrically connecting said movable switch contact and said second terminal, said movable switch contact being movable alternately into and out of engagement with said stationary switch contact to respectively close and open said electrical path;

an actuator for moving said movable switch contact into and out of engagement with said stationary switch contact;

said current interchange including an enclosure disposed on said housing for receiving one end of said movable switch contact and for electrical engagement with said second terminal and an electrical conductor having one end electrically connected to said movable switch contact and another end electrically connected to said second terminal;

an expansible seal extending into said enclosure and having an interior aperture for receiving said movable switch contact, one end of said seal being sealed to said housing and the other end of said seal being sealed to said one end of said movable switch contact;

said other end of said expansible seal being affixed to a spacer member disposed between said one end of said movable switch contact and a guide member for guiding said movable switch contact and further including a fastener member for attaching said spacer member and guide member to said movable switch contact.

8. A high voltage circuit interrupter comprising:

a first electrical terminal for connection to a first high voltage power lead;

a second electrical terminal for connection to a second high voltage power lead;

a rigid dielectric housing having a chamber;

a current interrupting vacuum switch disposed within said chamber for selectively opening and, alternatively, closing an electrical path between said first and second terminals;

said switch including a stationary switch contact in electrical engagement with said first terminal and a movable switch contact;

a current interchange electrically connecting said movable switch contact and said second terminal, said movable switch contact being movable alternately into and out of engagement with said stationary switch contact to respectively close and open said electrical path;

an actuator for moving said movable switch contact into and out of engagement with said stationary switch contact;

said current interchange including an enclosure disposed on said housing for receiving one end of said movable switch contact and for electrical engagement with said second terminal and an electrical conductor having one end electrically connected to said movable switch contact and another end electrically connected to said second terminal;

an expansible seal extending into said enclosure and having an interior aperture for receiving said movable switch contact, one end of said seal being sealed to said housing and the other end of said seal being sealed to said one end of said movable switch contact;

said housing including an end cap having a portion thereof extending into said chamber for supporting said one end of said expansible seal within said chamber.

9. A high voltage circuit interrupter comprising:

a first electrical terminal for connection to a first high voltage power lead;

a second electrical terminal for connection to a second high voltage power lead;

a rigid dielectric housing having a chamber;

a current interrupting vacuum switch disposed within said chamber for selectively opening and, alternatively, closing an electrical path between said first and second terminals;

said switch including a stationary switch contact in electrical engagement with said first terminal and a movable switch contact;

a current interchange electrically connecting said movable switch contact and said second terminal, said movable switch contact being movable alternately into and out of engagement with said stationary switch contact to respectively close and open said electrical path;

an actuator for moving said movable switch contact into and out of engagement with said stationary switch contact;

said current interchange including an enclosure disposed on said housing for receiving one end of said movable switch contact and for electrical engagement with said second terminal and an electrical conductor having one end electrically connected to said movable switch contact and another end electrically connected to said second terminal; and said electrical conductor including at least one electrical conductor extending from said movable switch contact to said second terminal.

10. A high voltage circuit interrupter comprising:

a first electrical terminal for connection to a first high voltage power lead;

a second electrical terminal for connection to a second high voltage power lead;

a rigid dielectric housing having a chamber;

a current interrupting vacuum switch disposed within said chamber for selectively opening and, alternatively, closing an electrical path between said first and second terminals;

said switch including a stationary switch contact in electrical engagement with said first terminal and a movable switch contact;

a current interchange electrically connecting said movable switch contact and said second terminal, said movable switch contact being movable alternately into and out of engagement with said stationary switch contact to respectively close and open said electrical path;

an actuator for moving said movable switch contact into and out of engagement with said stationary switch contact;

said current interchange including an enclosure disposed on said housing for receiving one end of said movable switch contact and for electrical engagement with said second terminal and an electrical conductor having one end electrically connected to said movable switch contact and another end electrically connected to said second terminal; and a guide member for guiding the movement of said movable switch contact within said enclosure.

11. The interrupter of claim 10 wherein said guide member includes at least one guide rod extending into said enclosure and an alignment member affixed to said one end of said movable switch contact, said alignment member engaging said guide rod to maintain alignment of said movable switch contact upon movement within said enclosure.

12. The interrupter of claim 11 wherein said electrical conductor includes at least one electrical cable helically extending around said guide rod and having ends electrically connected to said movable switch contact and said second terminal.

13. The interrupter of claim 12 wherein two guide rods extend into said enclosure from a base on said enclosure with said base being in electrical engagement with said second terminal, and two electrical cables having one end electrically affixed to said base and helically extending around said guide rods.

14. The interrupter of claim 13 wherein said alignment member includes two guide apertures each receiving a guide rod and said electrical cables having their other ends electrically affixed to said alignment member, said electrical cables having sufficient length to allow the movement of said movable switch contact.

15. The interrupter of claim 13 wherein said base includes an interchange base and a copper disk.

16. The interrupter of claim 14 further including guide bushings disposed in said guide apertures.

* * * * *